United States Patent [19]

Rhemer et al.

[11] Patent Number: 4,563,558

[45] Date of Patent: Jan. 7, 1986

[54] DIRECTIONAL RECRYSTALLIZATION FURNACE PROVIDING CONVEX ISOTHERM TEMPERATURE DISTRIBUTION

[75] Inventors: Chris C. Rhemer; James D. Formanack, both of Jupiter, Fla.

[73] Assignee: United Technologies Corporation, Hartford, Conn.

[21] Appl. No.: 565,497

[22] Filed: Dec. 27, 1983

[51] Int. Cl.[4] ..... H05B 6/40

[52] U.S. Cl. ..... 219/10.49 R; 219/10.43; 219/10.67; 219/10.79; 156/608; 156/DIG. 88; 164/122.2; 164/493; 373/157; 422/249

[58] Field of Search ..... 219/10.49 R, 10.57, 219/10.43, 10.75, 10.79, 10.67; 156/608, DIG. 88, DIG. 96; 422/246, 249; 164/122.1, 122.2, 493, 471, 507, 513; 373/155–157, 161–164; 266/129; 148/11.5 R, 13, 150, 154

[56] References Cited

U.S. PATENT DOCUMENTS

| | | | |
|---|---|---|---|
| 3,096,158 | 7/1963 | Gaulé et al. | 219/10.79 X |
| 3,975,219 | 8/1976 | Allen et al. | 148/11.5 N |
| 3,977,934 | 8/1976 | Lesk | 156/608 |
| 4,116,641 | 9/1978 | Ciszek | 156/608 |
| 4,142,063 | 2/1979 | Boniort et al. | 373/157 X |
| 4,242,553 | 12/1980 | Berkman et al. | 219/10.49 R |
| 4,318,753 | 3/1982 | Anderson, Jr. et al. | 148/162 X |
| 4,409,451 | 10/1983 | Taylor | 219/10.49 R |

*Primary Examiner*—Philip H. Leung
*Attorney, Agent, or Firm*—Charles E. Sohl

[57] ABSTRACT

Concepts for producing thermal conditions, in strip material, conducive to directional recrystallization are disclosed. An inductively heated susceptor contains a slot and the susceptor shape develops a thermal condition where the edges of the strip are cooler than the center of the slot. The furnace includes a fluid cooled cold zone as well as the hot zone and can produce a steep longitudinal thermal gradient in the strip.

7 Claims, 3 Drawing Figures

DIRECTIONAL RECRYSTALLIZATION FURNACE PROVIDING CONVEX ISOTHERM TEMPERATURE DISTRIBUTION

The Government has the rights in this invention pursuant to Contract No. F33615-80-C-5005 awarded by the Department of the Air Force.

DESCRIPTION

1. Technical Field

This invention relates to apparatus which can be used to directionally recrystallize certain metallic materials to produce an elongated grain structure. More particularly this furnace permits the reliable development of a single crystal recrystallized structure.

2. Background Art

Directional recrystallization is a technique for producing elongated grain microstructures in metallic materials in the solid state. In a typical process the starting material is treated to raise its internal energy, i.e., by deformation or by producing a particular microstructure (see U.S. Pat. No. 4,318,753 which is incorporated by reference). This treated material is passed through a thermal gradient, the hot end of which is at a temperature in excess of the recrystallization temperature (see U.S. Pat. No. 3,975,219 which is incorporated by reference). Conditions are controlled so that growth (of new grains) is encouraged rather than nucleation (of new grains).

The article "The Growth of Strain-Anneal Crystals of Predetermined Orientation" by Williamson and Smallman in Acta Metallurgica, Vol. 1, September 1953, starting at page 487, describes this technique as modified to produce single crystals. At the top of page 490 and in FIG. 2 at the bottom of page 490, reference is made to a furnace, which can be used to directionally recrystallize strip material, in which the strip edges are kept cooler than the center of the strip. Since grain growth occurs parallel to the temperature gradient (perpendicular to the isotherms), any stray grains will grow toward the edge of the strip and will be eliminated.

Patents showing apparatus which have some similarity to the invention to be described include U.S. Pat. Nos. 4,017,704; 3,096,158; 3,694,269 and 3,960,647. Of lesser pertinence are U.S. Pat. Nos. 3,848,107; 3,964,430; 4,012,616 and 4,185,183.

DISCLOSURE OF INVENTION

The invention comprises a furnace arrangement which develops a convex isotherm condition in strip material. The temperature distribution or temperature profile across the strip as it passes through the furnace is such that the center of the strip is at higher temperature than the edges of the strip. The strip also passes through a steep longitudinal thermal gradient as it passes from the cold zone to the hot zone.

This goal is accomplished through the use of an induction heating furnace which includes an inductively heated, shaped susceptor. The susceptor contains a slot through which the strip passes. The susceptor is heated by the induction coil and in turn heats the strip by radiation. The shape of the susceptor is chosen so that the edges of the slot are at a lower temperature than the center of the slot thus achieving the requisite convex isotherm condition.

Provisions are also made to provide a chill zone at the entry of the furnace to provide a steep longitudinal temperature gradient in the strip material.

Other features and advantages will be apparent from the specification and claims and from the accompanying drawings which illustrate an embodiment of the invention.

BEST MODE FOR CARRYING OUT THE INVENTION

Figure 1:
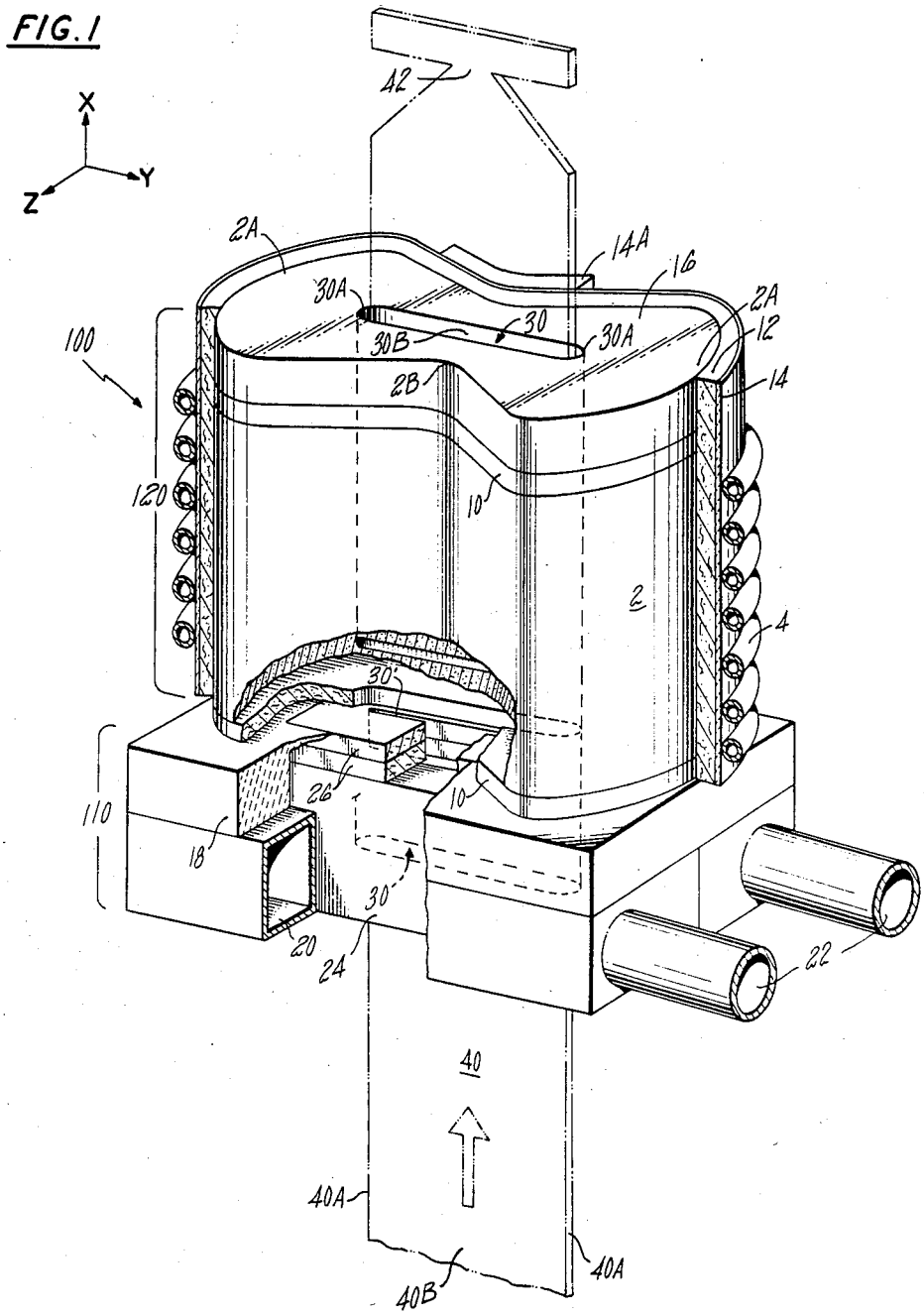
FIG. 1 is a perspective view of one embodiment of the invention.

FIG. 1 is a perspective view of an embodiment of the invention detailing a specific usable furnace design. The workpiece 40 to be directionally recrystallized passes through a slot 30 which extends through the furnace 100, entering the cold zone 110 and exiting after passing through the hot zone 120. The desired result is that the strip edges 40A, 40A be at a lower temperature than the strip center, 40B, when the strip temperature is in the range where recrystallization and grain growth can occur. Another desired benefit is that the strip passes through a steep longitudinal gradient in passing from the cold zone 110 to the hot zone 120.

Figure 2:
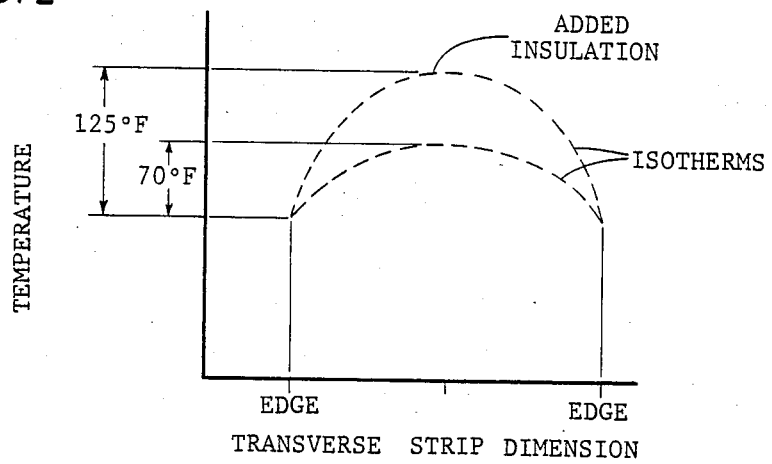
FIG. 2 shows the transverse thermal profile produced by the FIG. 1 apparatus.

Significant invention features are found in the hot zone 120 which includes a conforming induction coil 4 which inductively heats a shaped conductive graphite susceptor 2 which in turn heats, by radiation, the workpiece strip 40. The susceptor 2 has a bow-tie shape cross section, including end regions 2A, 2A of greater thickness than the center region 2B thickness. The thickness through the susceptor 2 from the exterior into the slot 30 is therefore greater at the ends 30A, 30A of the slot 30 than at the center of the slot 30B. The frequency of the induction heating field is selected so that substantially complete energy absorption occurs in a thickness of the susceptor material which is less than the susceptor thickness (from the exterior into the slot) at the slot center 30B. Accordingly, heat transfer to the slot ends 30A, 30A is impeded by the thermal resistance of the increased susceptor thickness. Since the energy source (induction coil 4) supplies substantially uniform energy density to the susceptor, the desired thermal gradient is achieved by modulating the heat flux to the slot by varying the conductivity from the exterior of the susceptor 4 to the slot 30. Thus the shaped susceptor 2 produces a convex isotherm condition in the workpiece 40 (the edges 40A, 40A of the strip 40 are at a lower temperature than the center 40B of the strip) as shown in FIG. 2. As has been discussed, this is a desirable condition for the growth of single crystals by directional recrystallization.

In a specific furnace design used to process a $2\frac{1}{2}''$ wide strip, the bow-tie susceptor 2 has a long dimension (in the Y direction in FIG. 1) of about 6". The thickness (in the Z direction) at the ends 2A, 2A is about $3\frac{1}{4}''$ while the thickness (again in the Z direction) at the center 2B of the susceptor is about $1\frac{1}{2}''$. The slot 30 thickness is about $\frac{1}{2}$ in the Z direction and about 3" in width in the Y direction. The susceptor thickness from the susceptor exterior to the slot 30 varied from about $1\frac{1}{2}$–$1\frac{3}{4}''$ at the slot ends 30A, 30A to about $\frac{1}{2}''$ at the slot center 30B. The susceptor dimension in the X direction was about 4". The susceptor must be a conductor so that it may be heated inductively. Graphite is conveniently employed since it can withstand extreme temperatures. Use of graphite however requires a vacuum or other inert environment. The induction coil was energized with a 3000 Hz power source. The power setting was approximately 10 Kilowatts.

In the embodiment depicted in FIG. 1, the susceptor 2 is surrounded by a compliant layer of graphite felt, 10 and 12. Exterior of the graphite felt is a layer of insulation 14 (on the sides) and 16 and 18 (on the ends). In a particular embodiment, zirconia felt was used for insulator 14 and alumina-silicate pressed fiberboard (Kaowool, a trademark of Babcock and Wilcox Co.) for insulator 16. A furnace built as described produced a 70° F. differential between the center and edges of a workpiece strip. Adding extra insulation 14A (zirconia felt) in the vicinity of the center region of the bow tie increased the differential to 125° F. by reducing heat loss to the exterior of the susceptor in the center region.

Figure 3:
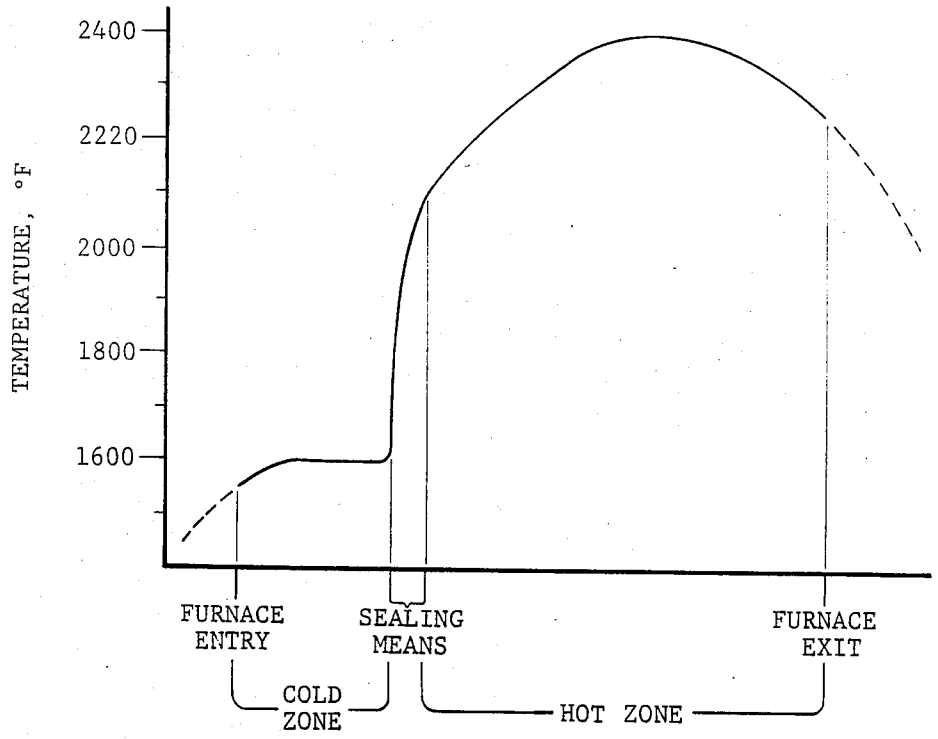
FIG. 3 shows the longitudinal thermal profile produced by the FIG. 1 apparatus.

The hot zone 120 and particularly the shaped susceptor 2 establishes the desired convex isotherm profile in the strip as shown in FIG. 2 (for the case of added center region insulation). It is also desirable to have a steep longitudinal thermal gradient between the cold zone 110 and the hot zone 120. This is provided by the sealing means 26 between the cold zone 110 and the hot zone 120 which reduces the area of the slot 30. The reduced area slot 30' in the sealing means 26 frictionally engages the workpiece strip thereby reducing radiation heat losses from the hot zone 120 to the cold zone 110. The longitudinal strip thermal profile of the strip obtained with the previously described furnace embodiment is shown in FIG. 3. The thermal information shown in FIGS. 2 and 3 was measured in $2\frac{1}{2}$" wide×0.030 thick nickel base superalloy strip material moving through the furnace at a rate of about $\frac{1}{2}$" per hour.

The cold zone includes (in a particular embodiment) a fluid cooled base 20 having inlet and outlet means 22 for a cooling fluid. Within the cooled base 20 is a chill block 24 which is in good thermal contact with base 20. In a particular embodiment the chill block is made of copper and the base 20 and the chill block 24 may be combined. The slot 30 extends through the chill block and the workpiece strip 40 passing through the chill block 24 will be cooled thereby.

It is convenient to mount the furnace so that slot 30 is substantially vertical since this will assist in ensuring that the strip 40 is centrally located within the slot 30. A horizontal slot orientation would lead to strip deflection under the influence of gravity and this would be a particular problem in view of the low strength of the strip 40 material at the temperature in question.

The furnace is preferably operated in a vacuum or inert environment because of the susceptibility of the strip 40 and the graphite susceptor 2 to oxidize at elevated temperatures.

One possible strip 40 configuration is shown in FIG. 1 and has notches 42 cut in it defining a section of reduced area 44. Only one of the crystals which will nucleate in area 46 when the strip 40 first passes into the furnace will grow through area 44 into the body of the strip. After this selected single crystal passes through the constriction, it will broaden out and occupy the entire strip. The effect of the curved thermal gradient is to preserve the single crystal nature of the structure which grows in the strip by forcing any grains which may nucleate to grow out of the strip inasmuch as these edge nucleated grains will grow normal to the thermal gradient. Even in the absence of an intentional grain selector such as that shown, the effect of passing a long strip of material through this furnace is that a single grain will usually predominate inasmuch as between any two competing grains there will usually be a sufficient difference in the growth rate such that one will eventually dominate the other and occupy the entire strip.

In superalloy materials grain growth is related to the gamma prime solvus temperature since below the solvus temperature the presence of from 25–70% by volume of the gamma prime phase will substantially prevent grain growth. Thus it is necessary for the temperature of the material to exceed the gamma prime solvus temperature so that the gamma prime phase will be dissolved permitting grain growth. Thus the hottest portion within the slot in the susceptor will be controlled to be in excess of the gamma prime solvus temperature (but below the incipient melting temperature). Material processed to date has been prepared in accordance with the teachings of U.S. Pat. No. 4,318,753. Of course the invention is not restricted to superalloys and other preparation techniques may be substituted for those taught in U.S. Pat. No. 4,318,753.

It should be understood that the invention is not limited to the particular embodiments shown and described herein, but that various changes and modifications may be made without departing from the spirit and scope of this novel concept as defined by the following claims.

We claim:

1. Heating means for developing a convex isotherm condition in strip material including:

a shaped conductive susceptor containing a centrally located, elongated slot which is shaped to receive a strip to be treated, passing therethrough, said slot having a longitudinal axis extending in the direction of the path of the moving strip, said susceptor having an exterior surface and being shaped so that in cross section, the plane perpendicular to said axis, the shortest distance from each of the slot ends to the susceptor exterior is greater than the shortest distance from the slot center to the susceptor exterior;

an induction coil surrounding the susceptor;

means for energizing the coil at a frequency selected so that substantially complete energy absorption occurs in a thickness of susceptor material less than or equal to said shortest distance from the slot center to the susceptor exterior.

2. Heating means in claim 1 which further includes a layer of insulation on the exterior of the susceptor in the central region to increase the temperature difference between the center of the slot and the edges of the strip.

3. Heating means as in claim 1 including a layer of insulation on the exterior of the susceptor.

4. Heating means as in claim 1 in which the susceptor has a substantially bow tie shaped cross section.

5. Heating means for developing a transverse isotherm condition in a strip material in combination with a steep longitudinal thermal gradient in the strip material including:

a cold zone which includes a fluid cooled base having a slot extending therethrough, said slot being an extension of the slot which passes through the hot zone;

a hot zone which includes an inductively heated shaped susceptor containing a centrally located elongated slot which is shaped to receive a strip to be treated, passing therethrough, said slot having a longitudinal axis extending in the direction of the path of the moving strip, said susceptor having an exterior surface and being shaped so that in cross section, the plane perpendicular to said axis, the shortest distance from each of the slot ends to the susceptor exterior is greater than said shortest distance from the slot center to the susceptor exterior;

means for providing an induction heating field at a frequency which will be substantially completely absorbed by a thickness of susceptor material less than or equal to the distance from the slot center to the susceptor exterior.

6. Heating means as in claim 5 further including sealing means mounted in the slot and located between the hot zone and cold zone;

said sealing means being adapted to engage the strip as it from the cold zone to the hot zone to reduce heat transfer between the hot zone and cold zone.

7. Heating means as in claim 5 in which the susceptor has a substantially bow tie shaped cross section.

* * * * *